US005968318A

United States Patent [19]

Hasegawa et al.

[11] Patent Number: 5,968,318

[45] **Date of Patent: *Oct. 19, 1999**

[54] SHOE PRESS BELT AND MANUFACTURING METHOD THEREFOR

[75] Inventors: Yasuo Hasegawa, Nagareyama; Kenji Inoue, Tokyo, both of Japan

[73] Assignee: Ichikawa Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/094,829

[22] Filed: Jun. 15, 1998

[30] Foreign Application Priority Data

Jul. 3, 1997 [JP] Japan ..... 9-194739

[51] Int. Cl.[6] ..... D21F 3/02; B05D 3/12

[52] U.S. Cl. ..... 162/358.4; 162/901; 427/171; 427/177

[58] Field of Search ..... 162/385.4, 901; 427/171, 177; 264/103

[56] References Cited

U.S. PATENT DOCUMENTS

| | | | |
|---|---|---|---|
| 4,812,185 | 3/1989 | Romanski . | |
| 4,944,820 | 7/1990 | McCarten . | |
| 5,134,010 | 7/1992 | Schiel . | |
| 5,238,537 | 8/1993 | Dutt | 162/358.4 |
| 5,772,848 | 6/1998 | Dutt | 162/358.4 |

FOREIGN PATENT DOCUMENTS

| | | |
|---|---|---|
| 64-45889 | 2/1989 | Japan . |
| 1-503315 | 11/1989 | Japan . |
| 1-298292 | 12/1989 | Japan . |
| 3-57236 | 8/1991 | Japan . |
| 5-505428 | 8/1993 | Japan . |
| WO92/02678 | 2/1992 | WIPO . |

*Primary Examiner*—Christopher Raimund
*Attorney, Agent, or Firm*—Quarles & Brady

[57] ABSTRACT

A shoe press belt for the shoe press of a paper making machine includes first and second resin layers and a base layer. Resin is coated and cured on the polished surface of a cylindrical mandrel to form the first resin layer endlessly. An inner layer of the base layer is formed by spirally winding a relatively narrower belt shaped mesh with warp threads running in the major direction of the belt and weft threads running perpendicular thereto, with the weft threads against the outer surface of the first resin layer, and without overlapping the end edges of the belt-shaped mesh. An outer layer of the base layer is formed by inserting the mandrel, with the first resin layer and the belt-shaped mesh layer applied, into a tubular mesh, and pulling the ends of the tubular mesh apart, so as to reduce its diameter and press it radially against the belt-shaped mesh layer. A second resin layer is then applied over the base layer and impregnates the base layer down to the outer surface of the first resin layer, so that the base layer is included within the second resin layer when the second resin layer is cured.

2 Claims, 5 Drawing Sheets

SHOE PRESS BELT AND MANUFACTURING METHOD THEREFOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a shoe press belt for manufacturing paper, and more particularly to a closed type shoe press belt and a manufacturing method therefor.

2. Discussion of the Prior Art

Shoe presses, which are used in the pressing unit of a paper making machine, are typically of two types: an open type and a closed type. Of these types, the closed type shoe press is mainly used in recent years because the open type shoe press requires a larger installation space and potentially harmful oil diffusion has been associated with it.

FIG. 7 shows a closed type shoe press. Referring to FIG. 7, numeral 11 denotes a press roll, numeral 12 denotes a shoe, and numeral 13 denotes a shoe press belt. The shoe press belt 13 is formed endlessly, and travels together with a top felt 15, a wet (paper) web 14 and a bottom felt 15' so that the wet web is wrung dry by pressurization between the press roll 11 and the shoe 12.

The shoe press belt 13 is driven through the felt 15, the wet web 14 and the felt 15' by the press roll 11 as the driving source. More specifically, when the shoe press belt 13 travels in the leftward direction indicated by the arrow in FIG. 8, a pressurized portion (the cross-hatched portion) and a non-pressurized portion (the portions which are not cross-hatched) occur at both ends of the shoe 12 in the CMD direction (FIG. 1) at the boundary between the pressurized and un-pressurized portions. A driving force is exerted on the pressurized portion, while both end portions, which are not pressurized, lag. Therefore, the shoe press belt 13 is subjected to stress S in an oblique direction (in the bias direction indicated by the arrows S in FIG. 8) in the end portions of the belt, causing distortion which results in cracks.

Moreover, since the conditions of use are severe owing to a short length of circumference (dimension) of the shoe press belt, durability of the belt is highly desirable, and various measures are taken to make it durable in its structure and method of manufacture.

Typical such measures are described in Japanese Patent Publication No.3-57236, Japanese Laid-Open Patent Application No.64-45889, Japanese Translation of Unexamined PCT appln. No.1-503315, Japanese Laid-Open Patent Application No.1-298292 and Japanese Translation of Unexamined PCT appln. 5-505428.

According to the Japanese Patent Publication No.3-57236, however, the base fabric of the shoe press belt is installed around a mandrel and resin is poured onto the fabric. This is performed by using the so-called die forming method, which to its merit that uniform thickness and surface smoothness can be obtained, but has a problem that it is difficult to uniformly set the position of the base fabric in the width (i.e., CMD) direction.

According to the Japanese Laid-Open Patent Application No.64-45889, after an uncured resin sheet is installed around a mandrel, the mandrel is covered with base fabric on top of the resin sheet, is further wound with a second uncured resin sheet, and is finally wound with a ribbon consisting of heat-shrinkable resin to be thermally shrunken. In this case, since the base consists of fabric, it is difficult to dimensionally match circumferentially, which may possibly cause pinholes.

According to the Japanese Translation of Unexamined PCT appln. No. 1-503315, no fabric is used as the base, but thread is stretched over the overall circumference at predetermined intervals in the axial direction (CMD direction) of the mandrel, on top of which thread is spirally wound in the circumferential direction (MD direction), and resin is supplied for formation of the belt. This method has to its merit that the change in dimension due to tension in the CMD direction is small, but has a difficulty in that it takes time to manufacture.

Further, according to the Japanese Translation of Unexamined PCT appln. No. 1-298292, a mat-shaped fibrous belt is impregnated with uncured resin, and is spirally wound around the mandrel to be heated and cured. This shoe press belt has a problem with dimensional stability in both the MD direction and the CMD direction, and in addition, it peels.

Further, according to the Japanese Translation of Unexamined PCT appln. No.5-505428, fabric made of thread with a low elasticity modulus is used in the MD direction and thread with a higher elasticity modulus than the MD directed thread is used in the CMD direction. The fabric is impregnated with uncured resin, and is spirally wound around the mandrel to be cured. This shoe press belt is subject to peeling when a stress is applied to the overlapped portion of the wound fabric.

SUMMARY OF THE INVENTION

It is an object of the present invention to eliminate or reduce the above-described problems, and to provide a shoe press belt free from pinholes, having strength in the bias direction (i.e., in the oblique direction indicated by arrows S in FIG. 8) together with strength in the MD and CMD directions, to result in good durability, and a manufacturing method therefor.

In order to achieve the above-described object, a shoe press belt according to the present invention comprises a first resin layer formed endlessly; a base layer formed on the outer periphery of the first resin layer; and a second resin layer formed to impregnate the base layer. The base layer is formed of a composite layer consisting of an inner layer prepared by spirally winding a belt-shaped mesh so that its edge portions do not overlap, and an outer layer prepared by loosely covering the outer periphery of the inner layer with a tubular mesh and expanding both ends thereof to bring the tubular mesh into tight contact with the inner layer in such a manner that the base layer exhibits sufficient strength in the bias direction as well as in the MD and CMD directions.

To manufacture a shoe press belt of the invention, the first resin layer is endlessly formed on the polished surface of a mandrel. The inner layer of the base is formed by spirally winding the outer periphery of the first resin layer with the belt-shaped mesh so that the edge portion thereof does not overlap, and the outer layer of the base is formed by loosely covering the outside of the inner layer with the tubular mesh. The two ends of the tubular mesh are then pulled apart to reduce the diameter of the tubular mesh and bring it into tight contact with the inner layer. The base layer is then coated and impregnated from the outer periphery of the outer layer of the base layer to form the second resin layer. The invention is constructed such that the base layer is capable of exhibiting sufficient strength in the bias direction as well as in the MD and CMD directions, and so that the shoe press belt including the base layer can be easily manufactured.

These and other objects and advantages of the invention will be apparent from the drawings and detailed description.

BRIEF DESCRIPTION OF THE DRAWINGS

FIG. 2(*b*) is an enlarged cross-sectional view of the shoe press belt of FIG. 1 viewed as if the belt was cut in the CMD direction;

FIG. 4(*b*) is a cross-sectional view of the mesh viewed as if the mesh was cut in the CMD direction; and FIG. 4(*c*) is a cross-sectional view of the mesh viewed as if the mesh was cut in the MD direction;

FIG. 5(*b*) is a front view like FIG. 5(*a*) but with both ends of the mesh expanded to bring the mesh into tight contact with the inner layer on the mandrel;

FIG. 6(*b*) is a front view like FIG. 5(*b*), but with the woven tubular mesh of FIG. 6(*a*);

DETAILED DESCRIPTION OF THE PREFERRED EMBODIMENTS

Figure 1:
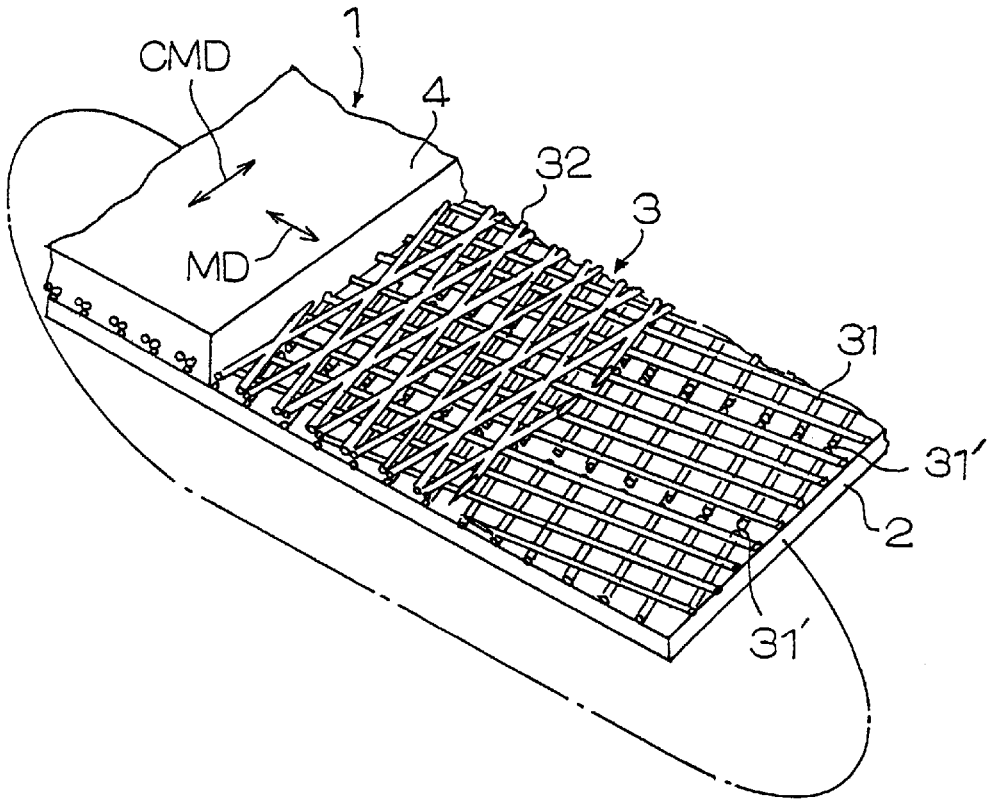
FIG. 1 is a enlarged perspective view showing a portion of a shoe press belt of the present invention.

The present application belt 1 is, as shown in FIG. 1, composed of a first resin layer 2 endlessly formed (i.e., formed in a loop as indicated by the dashed line), a base layer 3 having coarse meshes formed on the outer periphery of the first resin layer 2, and a second resin layer 4 formed to include the base layer 3. The second resin layer 4 penetrates through the coarse meshes of the base layer 3 to form a closed surface M at the outer periphery of the first resin layer 2 as shown in cross-section along the MD direction in FIG. 2(*a*) and in cross-section along the CMD direction in FIG. 2(*b*).

The base layer 3 is formed of a composite layer consisting of an inner layer 3A prepared by spirally winding the outer periphery of the first resin layer 2 with a belt-shaped mesh 31 so that its edge portions 31' do not overlap, and an outer layer 3B prepared by loosely covering the outer periphery of the inner layer 3A with a tubular mesh 32 and expanding both of its ends in opposite directions to bring the tubular mesh into tight contact with the mesh 31.

The inner layer 3A of the base layer 3 reinforces the circumferential direction (MD direction=belt traveling direction) while the outer layer 3B reinforces the axial direction (CMD direction=belt width direction).

The first resin layer 2 is formed on the polished surface of a mandrel 6 which is rotatable around a shaft 5 as shown in FIG. 3(*a*). In this case, the surface of the mandrel 6 is coated with a release agent (not shown) or a release sheet (not shown) is stuck on the surface thereof in advance, on top of which the first resin layer 2 is formed to be 0.5 mm to about 2 mm in thickness using a coating machine (such as a doctor bar or a coater bar) 7.

The first resin layer 2 and the second resin layer 4 are made of rubber or elastomer, and are preferably made of thermosetting polyurethane. The hardness is selected from 80 to 98° (JIS A). Of course, the first resin layer 2 and the second resin layer 4 do not always require the same hardness.

The belt-shaped mesh 31 constituting the inner layer 3A of the base layer 3 is spirally wound on the outer periphery of the first resin layer 2 so that the edge portions 31' do not overlap as shown in FIG. 3(*b*). The winding is effected so that the edge portions 31 ' do not overlap in order to prevent any stepped portion from being caused. Accordingly, when the edge portion 31' is spaced excessively apart, a stepped portion is also caused, and therefore, it is desirable not to cause it likewise.

Figure 4A:
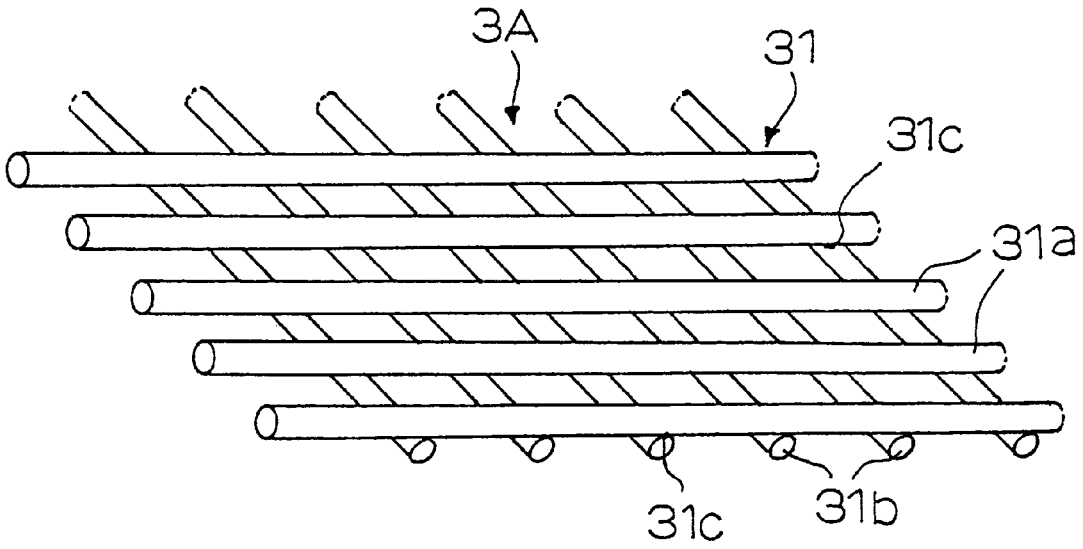
FIG. 4(*a*) is a perspective view showing a section of the belt-shaped mesh constituting the inner layer of the base layer.
Figure 4B:
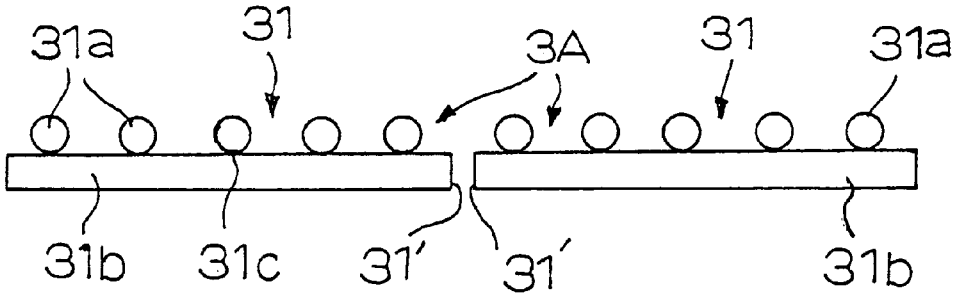
Figure 4C:
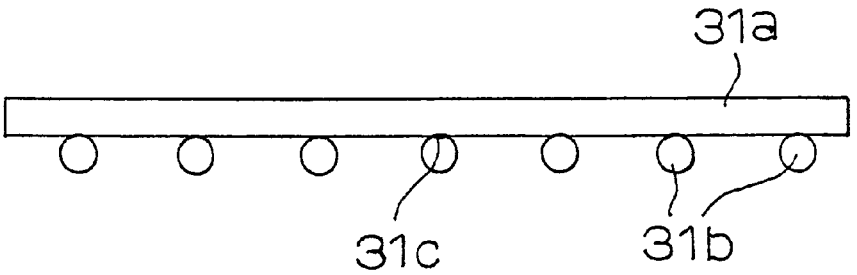

The belt-shaped mesh 31 constituting the inner layer 3A of the base layer 3 is not woven from the warp 31*a* and the weft 31*b* as shown in FIG. 4(*a*), but reticulate objects prepared by joining intersections 31*c* by solvent welding or adhering with adhesive are used.

In the belt-shaped mesh 31, since the warp 31*a* is continuous as shown in FIG. 4(*c*), it provides sufficient tenacity in the circumferential direction (MD direction) of the belt while since the weft 31*b* is not continuous as shown in FIG. 4(*b*), it does not provide any tenacity in the belt-width direction (CMD direction).

When the belt-shaped mesh 31 is wound on the outer periphery of the first resin layer 2 as shown in FIG. 3(*b*), the winding operation is preferably performed by rotating the mandrel 6 after the starting end 31" of the belt-shaped mesh 31 is stuck to the surface of the first resin layer 2 with adhesive or adhesive tape, or is fixed to the mandrel 6 through a catch.

Figure 2A:
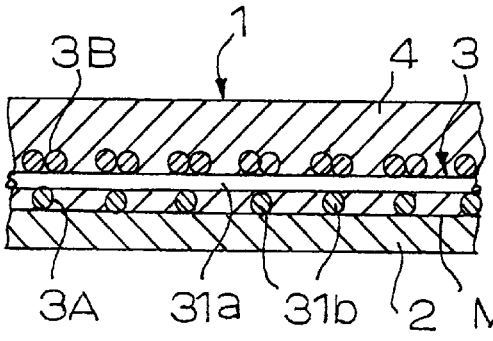
FIG. 2(*a*) is an enlarged cross-sectional view of the shoe press belt of FIG. 1 viewed as if the belt was cut in the MD direction.
Figure 2B:
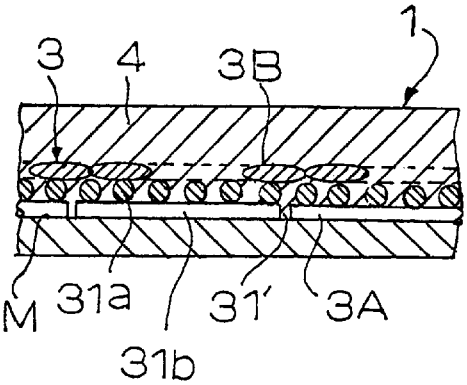
Figure 3A:
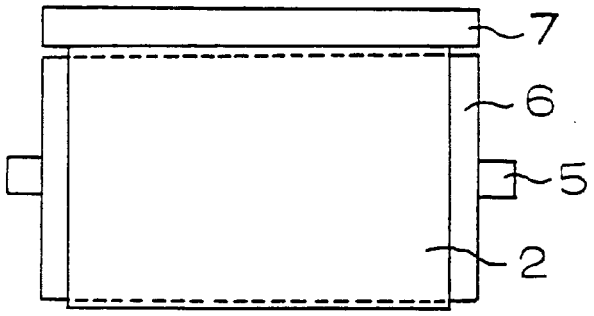
FIGS. 3(*a*), (*b*), (*c*) and (*d*) are front views showing the procedure for manufacturing a shoe press belt of the present invention.
Figure 3B:
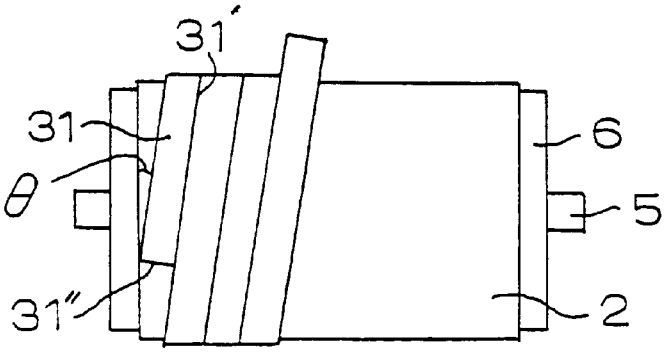
Figure 3C:
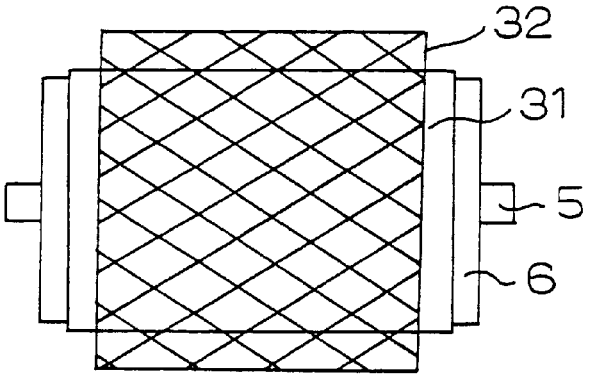
Figure 3D:
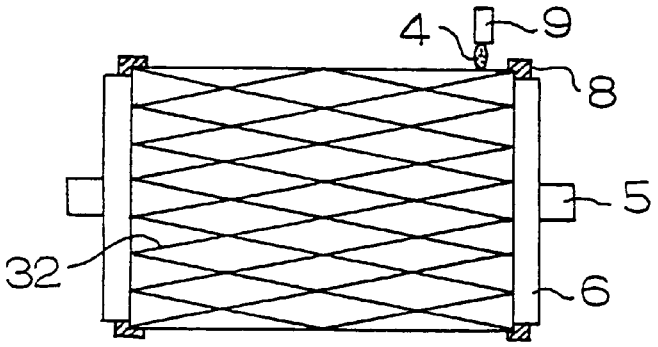

The belt-shaped mesh 31 is then wound in such a manner that the weft 31*b* comes into contact with the first resin layer 2 as shown in FIGS. 2(*a*) and (*b*). In other words, the warp 31*a* is not in contact with the first resin layer 2. Thereby, in case the second resin layer 4 is formed after the formation of the base layer 3, when uncured resin is spirally coated circumferentially from above the base layer 3, the clearance between the first resin layer 2 and the warp 31*a* makes a path into which resin can flow while the clearance created by the weft 31*b* makes an air flow path in the width direction through which air can flow to permit filling of the voids adjacent to the layer 2 by the resin. Accordingly, it becomes possible to completely fill the spaces in the inner and outer layers of the base layer with resin, thus making it possible to reliably prevent pinholes from occurring and to maintain sufficient dimensional stability circumferentially of the shoe press belt.

In order to spirally wind the belt-shaped mesh 31 on the outer periphery of the first resin layer 2 so that the edge portion 31' does not overlap, an angle θ of a certain degree is given to the circumferential direction as shown in FIG. 3(*b*). The angle θ is preferably set to less than approximately 6° in order to maintain the strength in the circumferential direction and to stabilize the axial traveling of the belt as it is spirally wound over the layer 2 on the mandrel 6. For this reason, the width of the belt-shaped mesh 31 is preferably less than approximately 50 cm for manufacture of a shoe press belt with a diameter of 1.5 m.

As the material for the warp 31*a* of the belt-shaped mesh 31, synthetic fiber having high elasticity modulus such as nylon, polyester, aromatic polyamide, aromatic polyimide and high-strength polyethylene is preferably used. It is also possible to use inorganic fiber such as carbon fiber and glass fiber. As regards the thickness of the fiber, monofilament, or multifilament with a diameter of 0.3 mm to 1.0 mm or their twisted yarn may be used. For the pitch of warp 31*a*, warp of 3 to 5 pieces per 10 mm is suitable for use.

For the thickness of the weft 31*b* of the belt-shaped mesh 31, it is necessary to form a sufficient clearance for preparing a resin flow path or an air flow path on coating the second resin layer 4 as described above. To this end, it is desirable for the radial dimension (relative to the mandrel) to be 0.5 mm to 1.0 mm. Also, as the pitch of the weft 31*b*, one to three pieces per 10 mm is suitable to maintain the impregnating ability of the resin. Further concerning the material of the weft 31*b*, monofilament or multifilament of synthetic fiber such as nylon and polyester or their twisted yarn can be satisfactorily used normally, although others may be suitable.

The tubular mesh 32 constituting the outer layer 3B of the base layer 3 is loosely covered on the outer periphery of the inner layer 3A as shown in FIG. 3(*c*), and thereafter when its both ends are expanded in opposite axial directions, i.e., when they are pulled apart so as to create a tensile load on the tubular mesh 32 from end to end, the mesh size of the tubular mesh 32 is pulled and made uniform in the expansion direction as shown in FIG. 3(*d*), and the inside diameter is compressed to bring it into tight contact with the outer periphery of the inner layer 3A.

Then, if the second resin layer 4 is impregnated, coated and fixed onto the tubular mesh 32, which is the outer layer 3B, from outside, the present application belt 1 is reinforced in the circumferential direction (MD direction=belt traveling direction) by means of the inner layer 3A of the base layer 3, and is reinforced in the axial direction (CMD direction= belt axial direction) by means of the outer layer 3B.

Figure 5A:
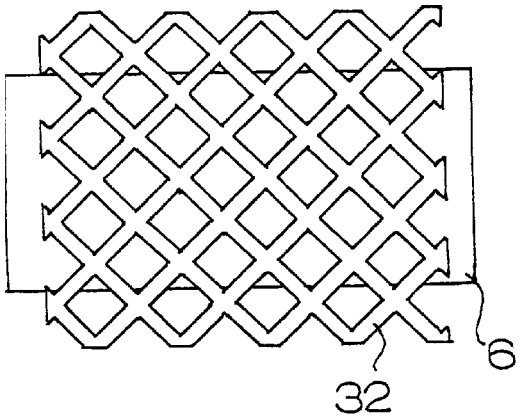
FIG. 5(*a*) is a front view showing a mandrel with the inner layer provided loosely covered with the tubular mesh (formed reticulate object) constituting the outer layer of the base layer.
Figure 5B:
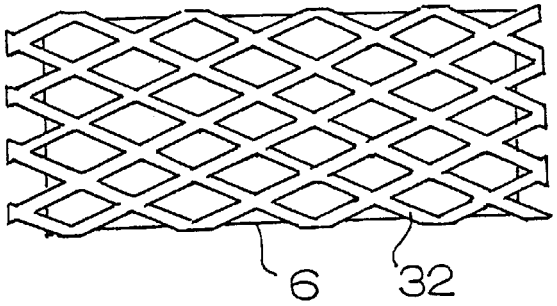

As the tubular mesh 32, a formed reticulate object or a punched reticulate object is used as shown in FIG. 5(*a*). More specifically, the meshes of these reticulate objects are substantially square in a free state, but diagonal to the axial (CMD) direction, so that when the ends are expanded in opposite directions, the meshes are pulled and made uniform in the axial direction as shown in FIG. 5(*b*), and function so that the inside diameter is compressed. Therefore, the present application belt will be able to secure sufficient dimensional stability in the axial direction (CMD—width direction).

Figure 6A:
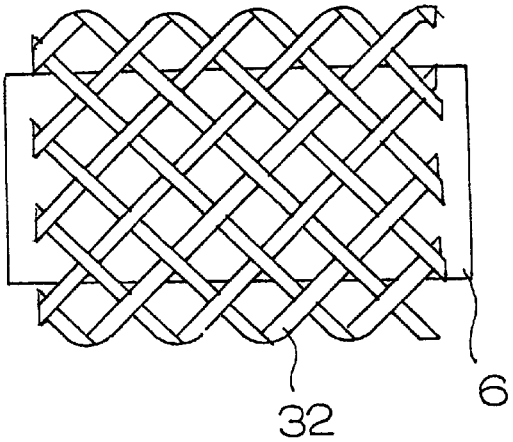
FIG. 6(*a*) is a front view like FIG. 5(*a*) but with the tubular mesh being woven.
Figure 6B:
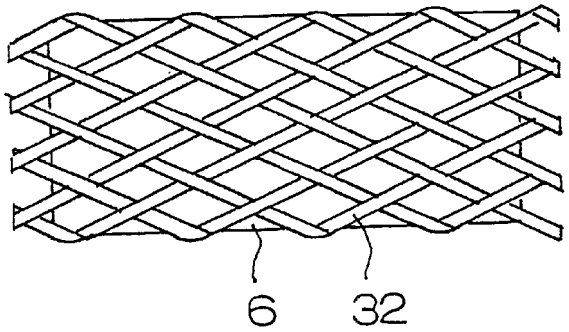
Figure 7:
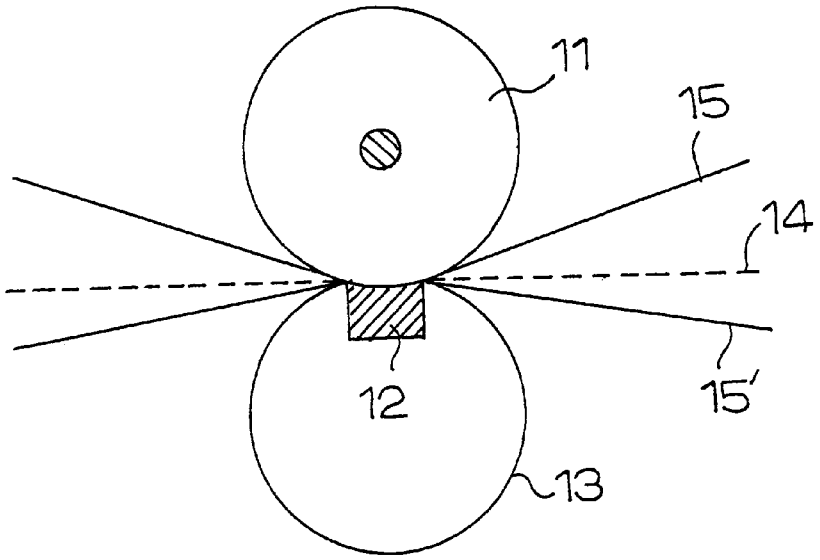
FIG. 7 is a schematic view showing a closed type shoe press.
Figure 8:
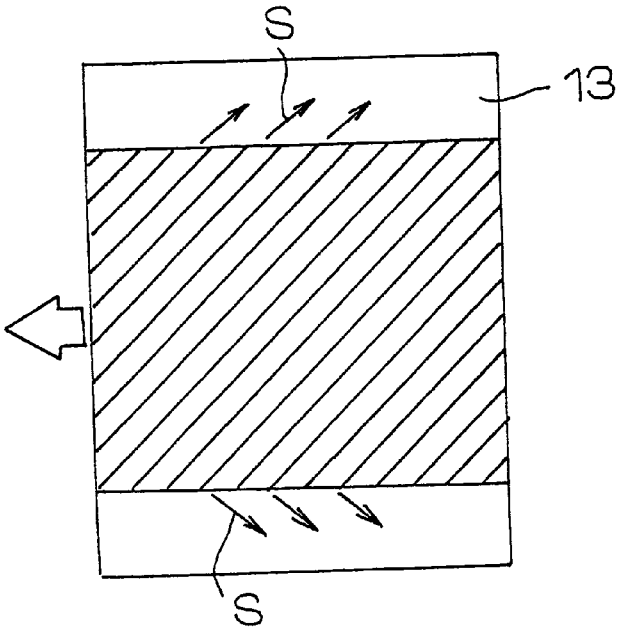
FIG. 8 is a plan view showing the pressurized portion and the non-pressurized portion of a shoe in a closed type shoe press.

Also, as the tubular mesh 32, a reticulate object may be used as shown in FIG. 6(*a*). The material of the tubular mesh 32 may be knitted (thread intersections formed with loops or knots), or not knitted. In the mesh illustrated in FIG. 6(*a*), the threads run spirally and obliquely and are crossed with each other (i.e., the material is woven) and are not knotted (i.e., the material is not knitted). When the two ends of the tubular mesh 32 are expanded in opposite directions, the meshes (i.e., the open spaces between the threads) are elongated and made uniform in the axial (CMD) direction as shown in FIG. 6(*b*), which reduces the length of the meshes in the circumferential (MD) direction so as to function to reduce the inner diameter of the mesh 32. In this state, the thread density is preferably about three to five pieces/cm in the MD direction.

The expression that the meshes of the tubular mesh 32 are elongated and made uniform in the axial direction (width direction) does not mean that the threads constituting the meshes are in tight contact with each other. Namely, the resin of the second resin layer 4 impregnates through the meshes of the base layer 3 and coats the threads of it so that the second resin layer 4 is in contact at surface (M) with the first resin layer 2, with the base layer 3 included within the second resin layer 4.

If the length of circumference of the tubular mesh 32 in a free state is set to two to four times that of the mandrel 6 so as to allow the tubular mesh 32 to be loosely installed to the outer periphery of the belt-shaped mesh 31, which becomes the inner layer 3A of the base layer 3, the tubular mesh 32 will be brought to tight contact with the outer periphery of the belt-shaped mesh 31. This construction helps provide sufficient strength to react against the stresses S acting in the bias direction in the finished shoe press belt.

As the thread material for the tubular mesh 32, synthetic fiber having high elasticity modulus such as nylon, polyester, aromatic polyamide, aromatic polyimide and high strength polyethylene is preferably used. It is also possible to use inorganic fiber such as carbon fiber and glass fiber. As regards the thickness of the fiber, monofilament, or multifilament with a diameter of 0.3 mm to 1.0 mm or their twisted yarn may be used.

When the tubular mesh 32 is loosely covered on the outer periphery of the first resin layer 2, more precisely on the outer periphery of the inner layer 3A of the base layer, and the two ends are expanded to compress the inner diameter, the two ends are fixed by ring-shaped clamp plates 8 at both end portions of the mandrel 6.

Thereafter, resin material R is supplied spirally through a nozzle 9 as shown in FIG. 3(*d*) to form the second resin layer 4. Thereby, the second resin layer 4 penetrates through the meshes of the base layer 3 to be brought into intimate contact and bond with the outer surface (M) of the first resin layer 2. In order to improve this adhesion effect, primer or adhesive may be used.

After the forming (curing), the shoe press belt is finished by polishing so that the overall thickness becomes a desired thickness. Grooves may be formed in the surface (belt surface) of the second resin layer 4 as required. Thereafter, the whole shoe press belt is removed from the mandrel 6.

In order to facilitate the removal operation, a release agent may be coated or a release sheet may be stuck on the surface of the mandrel 6 in advance in advance of building up the several layers. Also, as the removal method, hydraulic pressure or expansion and shrinkage of resin may be utilized.

FIRST EXAMPLE

After a release agent (KS-61 commercially available from The Shin-Etsu Chemical Co., Ltd.) is applied to the polished surface of a mandrel with a diameter of 1.5 m, thermosetting urethane (prepolymer: Takenate L2395 produced by Takeda Pharmaceutical Co., Ltd., and curing agent 3,3'.dichloro 4,4.diaminodiphenyl methane, 95° (JIS-A)) are coated to a thickness of 1 mm using a doctor bar installed in parallel to the mandrel to form the first resin layer, which was heated and cured.

Next, on the outer periphery of the first resin layer 2, a belt-shaped mesh (30 cm wide) using polyester multi-thread of 4000 denier for both warp and weft is spirally wound at an angle of 3.6° to the circumferential direction to form the inner layer of the base layer.

Then, a tubular mesh (reticulate object made of knit material) interwoven so as to have a length of circumference twice that of the mandrel using Kevlar thread of 4000 denier is loosely covered on the outer periphery of the inner layer, its both ends are expanded in opposite directions by tension of 10 kg/cm, and they are fixed by ring-shaped clamp plates to form the outer layer of the base layer.

Next, the same thermosetting urethane as the first resin layer is impregnated through the coarse meshes of the base layer and coated over them from outside the outer layer of the base layer to form the second resin layer with a thickness of substantially 5 mm, from the surface M to the outer surface of the second resin layer. Then, the belt on the mandrel is heated, cured at 100° C. for five hours, and is polished to have an overall thickness of 5.5 mm, and further grooves are formed in the circumferential direction with a rotary tooth to obtain a belt 1 of the present invention.

SECOND EXAMPLE

A belt 1 was obtained on the same conditions as the first example except that as the tubular mesh, an unknitted structure was used in place of the knitted structure.

Comparative Example

After a release agent (K5-61 from The Shin-Etsu Chemical Co., Ltd.) is applied to the polished surface of a mandrel with a diameter of 1.5 m, thermosetting urethane (prepolymer: Takenate L2395 produced by Takeda Pharmaceutical Co., Ltd., and curing agent 3,3'.dichloro 4,4.diaminodiphenyl methane, 95° (JIS-A)) are coated to a thickness of 1 mm using a doctor bar installed in parallel to the mandrel to form the first resin layer, which was heated and cured.

Next, on the outer periphery of the first resin layer, fabric woven endlessly using Kevlar multi-yarn of 4000 denier for both warp and weft is wound, its surface is coated with the same thermosetting urethane as described above at a thickness of substantially 5 mm, is heated and cured at 100°C. for five hours, is further polished so as to have the overall thickness of 5.5 mm, and grooves are formed circumferentially by a rotary tooth to obtain a comparative belt.

When the present application belts manufactured by the above-described method and the comparative belt were repeatedly subjected to flex tests, the present application belts for both first and second embodiments were free from abnormalities after one million cycles, whereas cracks occurred in the comparative belt at seven hundred thousand cycles.

As described above, a shoe press belt according to the present invention is characterized in that it comprises a first resin layer formed endlessly; a base layer formed on the outer periphery of the first resin layer; and a second resin layer formed to include the base layer. The base layer is formed of a composite layer consisting of an inner layer prepared by spirally winding a belt-shaped mesh so that its edge portion does not overlap, and an outer layer prepared by loosely covering the outer periphery of the inner layer with a tubular mesh and expanding its two ends to bring the tubular mesh into tight contact with the belt shaped mesh. Therefore, the first resin layer securely adheres to the second resin layer through the base layer consisting of a composite layer of the belt-shaped mesh and the tubular mesh, and this leads to the effect that the peeling durability is not only improved, but also no pinholes are produced, and high durability can be obtained against stress S which is caused between the pressurized portion and the non-pressurized portions of the belt.

Also, the invention is more particularly characterized in that on the polished surface of the mandrel, the first resin layer is endlessly formed, the outer periphery of the first resin layer is spirally wound with a belt-shaped mesh so that the edge portions thereof do not overlap to form an inner layer of the base, on the outside of which the tubular mesh is loosely covered, and both ends of the tubular mesh are expanded to bring the two meshes into tight contact with each other to thereby form the base. Thereafter, the second resin layer is impregnated and coated from the outer periphery of the outer layer of the base for formation of the belt, and this leads to the effect that it is possible to simply manufacture a base layer capable of exhibiting sufficient strength in the bias direction as well as in the MD direction and in the CMD direction, and a shoe press belt having the same.

We claim:

1. A shoe press belt, comprising: a first resin layer formed endlessly; a base layer formed on the outer periphery of said first resin layer; and a second resin layer formed to include said base layer, said base layer being formed of a composite layer consisting of an inner layer including a belt-shaped mesh spirally wound on said outer periphery of said first resin layer so that edge portions of said belt-shaped mesh do not overlap, and an outer layer including a tubular mesh enveloping said inner layer and said first resin layer, said tubular mesh being stretched axially so as to press radially against said inner layer.

2. A method of manufacturing a shoe press belt, comprising the steps of:

endlessly forming a first resin layer on a polished surface of a mandrel;

forming an inner layer of a base by spirally winding a belt-shaped mesh on the outer periphery of said first resin layer so that edge portions of said belt-shaped mesh do not overlap;

thereafter forming an outer layer of said base by loosely covering the outside of said inner layer with a tubular mesh and expanding both ends of said tubular mesh to bring the tubular mesh into tight contact with said inner layer; and forming a second resin layer by impregnating and coating said base from the outer periphery of said outer layer with a resin which forms said second resin layer.

* * * * *